US011015269B2

(12) United States Patent
Vanbostal

(10) Patent No.: US 11,015,269 B2
(45) Date of Patent: May 25, 2021

(54) VELOUR FABRIC AND METHOD OF MANUFACTURING A VELOUR FABRIC

(71) Applicant: De Poortere Frères S.A., Mouscron (BE)

(72) Inventor: Jean-Pierre Vanbostal, Tournai (BE)

(73) Assignee: De Poortere Frères S.A., Mouscron (BE)

( * ) Notice: Subject to any disclaimer, the term of this patent is extended or adjusted under 35 U.S.C. 154(b) by 390 days.

(21) Appl. No.: 15/320,615

(22) PCT Filed: Jun. 17, 2015

(86) PCT No.: PCT/EP2015/063589
§ 371 (c)(1),
(2) Date: Dec. 20, 2016

(87) PCT Pub. No.: WO2015/197444
PCT Pub. Date: Dec. 30, 2015

(65) Prior Publication Data

US 2017/0152613 A1 Jun. 1, 2017

(30) Foreign Application Priority Data

Jun. 23, 2014 (BE) ..... 2014/0486

(51) Int. Cl.
*D03D 3/00* (2006.01)
*D03D 27/00* (2006.01)
(Continued)

(52) U.S. Cl.
CPC ..... *D03D 27/00* (2013.01); *D03D 15/00* (2013.01); *D06C 7/00* (2013.01); *D06C 23/04* (2013.01);
(Continued)

(58) Field of Classification Search
CPC ..... D03D 15/00; D03D 27/00; D06C 7/00; D06P 5/2066
(Continued)

(56) References Cited

U.S. PATENT DOCUMENTS 3,542,086 A * 11/1970 Crenshaw ..... D03D 27/00 139/402
5,509,931 A * 4/1996 Schmitt ..... A61F 2/06 623/1.33
(Continued)

FOREIGN PATENT DOCUMENTS

DE 195 06 037 A1 8/1996
EP 0 568 916 A1 11/1993

OTHER PUBLICATIONS

International Search Report for International Application No. PCT/EP2015/063589, dated Aug. 28, 2015.

*Primary Examiner* — Jacob T Minskey
*Assistant Examiner* — Cedrick S Williams
(74) *Attorney, Agent, or Firm* — Knobbe, Martens, Olson & Bear, LLP

(57) ABSTRACT

The invention provides a velvet fabric and a method of making the fabric. The fabric includes a support formed by weft yarns and warp yarns, such that the weft yarns are inserted and interwoven with the warp yarns, and at least one filling yarn is anchored in the form of loops or bristles in the support. The support has two surfaces and the filling yarn emerges from at least one surface of the support. The warp yarns and/or the weft yarns of the support are at least partially formed of polyester at a low melting temperature.

12 Claims, 1 Drawing Sheet

(51) Int. Cl.

| | |
|---|---|
| ***D03D 15/00*** | (2021.01) |
| ***D06C 7/00*** | (2006.01) |
| ***D06C 23/04*** | (2006.01) |
| ***D06P 3/52*** | (2006.01) |
| ***D06P 3/60*** | (2006.01) |
| ***D06P 5/20*** | (2006.01) |

(52) U.S. Cl.
CPC ..... *D06P 3/52* (2013.01); *D06P 3/60* (2013.01); *D06P 5/2066* (2013.01); *D10B 2331/04* (2013.01)

(58) Field of Classification Search
USPC ..... 8/934
See application file for complete search history.

(56) References Cited

U.S. PATENT DOCUMENTS

| | | | | |
|---|---|---|---|---|
| 5,536,551 | A | 7/1996 | Woosley | |
| 5,604,009 | A | 2/1997 | Long et al. | |
| 5,618,624 | A | 4/1997 | Dinger et al. | |
| 2002/0019508 | A1* | 2/2002 | Branum | C08G 63/668 528/272 |
| 2006/0134446 | A1* | 6/2006 | Stumpf | B41M 5/3335 428/524 |
| 2008/0132133 | A1* | 6/2008 | Yasui | A41B 17/00 442/200 |
| 2014/0237747 | A1* | 8/2014 | Torri | D04B 21/04 15/207.2 |

* cited by examiner

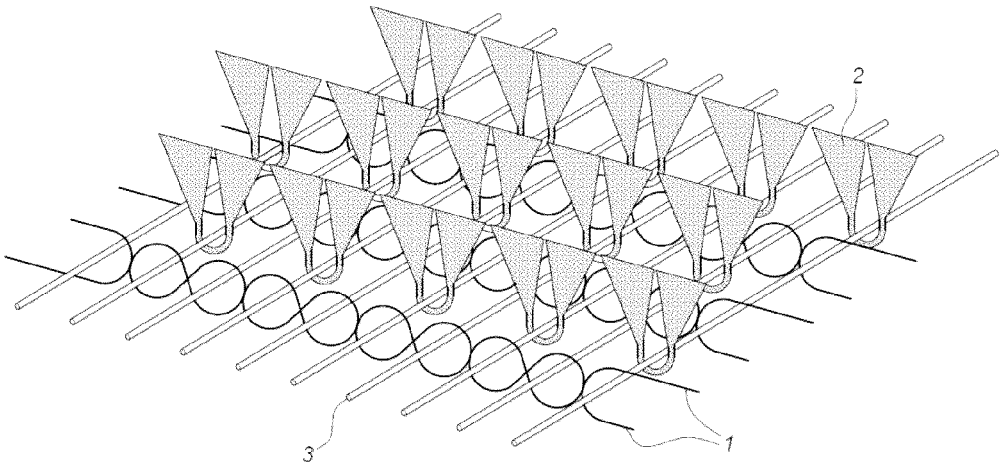
2
3
1

VELOUR FABRIC AND METHOD OF MANUFACTURING A VELOUR FABRIC

CROSS-REFERENCE TO RELATED APPLICATIONS

This application is the U.S. National Phase under 35 U.S.C. § 371 of International Application PCT/EP2015/063589, filed Jun. 17, 2015, which claims priority to BE2014/0486, filed Jun. 23, 2014.

The present invention relates to a velvet fabric and to a process for the manufacture of said velvet fabric. The invention also relates to the use of the velvet fabric in various applications such as the coating of various objects.

PRIOR ART

Velvet fabrics are widely used in the coating of various objects, mainly interior furnishing but also walls, interior cabin car parts, etc. Velvet fabrics are not rigid, they are relatively difficult to store and apply. The velvet fabrics are preferably stored in the form of rolls. Winding and unwinding can easily generate folds at the surface and at the bottom of the velvet fabrics. Thus, the application of non-rigid velvet fabrics can easily create visible defects at the level of the coating. A perfect coating, without visible defects, therefore requires an accurate application and an experienced workforce.

To give a certain rigidity to velvet fabrics, it is common to bond said velvet fabrics to rigid materials which are generally non-woven. This makes it possible to facilitate the storage in the form of rolls and the application in coating while avoiding the folds and the defects generated by the folds of said velvet fabrics. However, this step also requires a precision of application and experienced workforce to avoid any bad bonding of the velvet fabrics to the rigid materials which would cause a loss of the product. In addition, the bonding step requires the use of additional materials and equipment, in particular the rigid material and the adhesive as well as the bonding machine. Said step also extends the working time, thus increasing the production costs. Another disadvantage is the increase in the weight of the complex, formed by the velvet fabric, the adhesive and the rigid material, which makes it difficult to transport and manipulate.

The goal of the invention is to provide a solution to the problems described above. One of the objectives of the invention is to provide a rigid velvet fabric which can be wound. The invention also aims to provide a method for producing said velvet fabric. The method being simpler and less costly.

SUMMARY OF THE INVENTION

In a first aspect, the invention provides a velvet fabric comprising a support formed by weft yarns and warp yarns, such that the weft yarns are inserted and interwoven with the warp yarns, and at least one filling yarn anchored in the form of loops or bristles in the support. Said support has two surfaces and the filling yarn emerges from at least one surface of the support. The fabric is characterized in that the warp yarns and/or the weft yarns of the support are at least partially formed of polyester at low melting temperature.

In a second aspect, the invention provides a method of manufacturing a velvet fabric in which a support formed by warp yarns and weft yarns is used, such that the weft yarns are inserted and interwoven with warp yarns. The method comprises at least one step of inserting at least one filling yarn into the support so as to have said filling yarn anchored in the form of loops or bristles in the support and emerging from at least one surface of the support, thus obtaining the velvet fabric. The method is characterized in that the warp yarns and/or the weft yarns of the support are at least partially formed of polyester at a low melting temperature.

In a preferred embodiment, the process comprises at least one step of dyeing the velvet fabric, said dyeing is initiated at a temperature Ti and is continued at variable temperatures higher than the temperature Ti.

In a preferred embodiment, the process comprises at least one step of drying the velvet fabric wherein the drying temperature is comprised between 120 and 180° C., preferably between 130 and 170° C., more preferably between 140 and 160° C. Preferably, the duration of the drying step is comprised between 4 and 7 minutes. Preferably, the duration of the drying step is about 6 minutes.

In a third aspect, the invention provides the use of velvet for decorative and/or acoustic purposes. The velvet of the invention can, for example, be used in the automotive field and as a textile for furnishing.

The velvet fabric of the invention has several advantages. The fabric is rigid which in this way allows that it can be rolled easily and to store and/or transport it in the form of rolls. The coating of objects is improved and facilitated by using the velvet fabric of the invention. The coated objects are free of wrinkles and/or folds. The velvet fabric of the invention may be used to coat objects having a flat surface or a curved surface. The velvet fabric can be applied to the surface of the object to be coated by simple deposition of the fabric on the object and/or by using a glue and/or by heat sealing.

The method of the invention also has several advantages among which the reduction of the material necessary for the production of a rigid velvet fabric. Another advantage is the shortening of the production time of said fabric. Therefore, the method allows a considerable saving of time and costs. The present invention also allows to avoid the use of chemicals, for bonding the velvet fabric to a rigid material, thus reducing the release of chemicals into the environment. In addition, the velvet fabric produced by the method of the invention is lighter since it is devoid of glue and rigid material. The velvet fabric of the invention may be partially recyclable or 100% recyclable if all the yarns used to produce it are made of polyester, whatever the type of polyester is.

BRIEF DESCRIPTION OF THE FIGURES

FIG. 1 illustrates an example of a velvet fabric of the invention comprising a support formed by weft yarns and warp yarns and at least one filling yarn. The filling yarn is V-shaped.

DESCRIPTION

The invention relates to a method for producing a velvet fabric and the velvet fabric obtained by the process of the invention. The velvet fabric of the invention may be flame retardant. The invention also relates to the use of the velvet fabric in various applications.

The term "mass of yarns" is synonymous with the term "mass of threads" or also "count of yarns".

In a first aspect, the invention provides a velvet fabric comprising a support formed by weft yarns 3 and warp yarns 1, such that the weft yarns are inserted and interwoven with warp yarns as shown in FIG. 1. The fabric also comprises at least one filling yarn 2 anchored in the form of loops or bristles in the support. The filling yarn may be V-shaped as shown in FIG. 1 or W-shaped. The support has two surfaces 4, 5 and the filling yarn emerges from at least one surface of the support. The warp yarns 1 and/or the weft yarns 3 of the support are at least partially formed of polyester at a low melting temperature.

Preferably, the melting temperature of the warp yarns and/or the weft yarns of the support is low and is less than 250° C., preferably less than 200° C., more preferably less than 170° C., even more preferably about 160° C. The melting temperature of the warp and/or weft yarns is relative to the presence of the polyester at low temperature in said yarns. "About" as used herein refers to a measurable value such as a parameter, a quantity, a time duration, and the like, and is intended to encompass variations of +/−20% or less, preferably +/−10% or less, more preferably +/−5% or less, even more preferably +/−1% or less, and even more preferably +/−0.1% or less than and from the specified value, to the extent that such variations are suitable for carrying out the disclosed invention. The value to which the modifier "about" refers is itself also specifically disclosed.

Preferably, the composition of the warp yarns and/or weft yarns comprises at least 50%, preferably at least 60%, more preferably 65% of polyester at low melting temperature.

The mass of the warp yarns and the mass of the weft yarns is preferably comprised between 75 and 1100 dtex, preferably between 100 and 900 dtex, more preferably between 120 and 500 dtex, more preferably between 150 and 350 dtex. The weft yarns and the warp yarns may be of different or identical material.

The composition of the filling yarn may comprise one of the following materials: polyester, polyester at low melting temperature, viscose, cotton, linen, wool, silk, other polymers or any combination thereof. Preferably, the length of the filling yarn which emerges from at least one surface of the support is comprised between 0.2 and 5 mm, preferably between 0.5 and 3 mm, more preferably between 1 and 2 mm, even more preferably about 1.5 mm.

In a preferred embodiment, the support comprises at least 10, 12, 14 or 16 warp yarns per centimeter and at least 10, 12, 14 or 16 weft yarns per centimeter of a weaving loom. Preferably, the support comprises about 24 warp yarns per centimeter and around 21 weft yarns per centimeter.

In a second aspect, the invention provides a method of making a velvet fabric in which a support formed by warp yarns and weft yarns is used, such that the weft yarns are inserted and interwoven with warp yarns. The method comprises at least one step of inserting at least one filling yarn into the support so as to have said filling yarns anchored in the form of loops or bristles in the support and emerging from at least one surface of the support frame, thus obtaining the velvet fabric. Preferably, the warp yarns and/or the weft yarns of the support are at least partially formed of polyester at a low melting temperature. The velvet fabric of the present invention is provided by the manufacturing process of the invention.

Preferably, the melting temperature and the composition of the warp yarns and/or weft yarns is as described above.

In a preferred embodiment, the method comprises at least one step of dyeing the velvet fabric, said dyeing is initiated by dipping the velvet fabric into a dyeing liquid having a temperature Ti. The dyeing is continued in the same liquid but at variable temperatures. The variable temperatures are higher than the temperature Ti and are obtained by gradually increasing the initial temperature Ti. The initial temperature T 1 is at least 20° C., preferably at least 30° C., more preferably at least 40° C., even more preferably about 45° C. The variable temperatures of the dyeing liquid are comprised between 20 and 250° C., preferably between 30 and 200° C., more preferably between 40 and 180° C., even more preferably between 45 and 130° C.

In a preferred embodiment, the initial temperature Ti of the dyeing liquid is gradually increased by about 1 degree, preferably by about 2 degrees, until a first maximum temperature $T\mathbf{1}_{max}$ is reached. Thereafter, the temperature is gradually increased by about 1 degree, preferably about 2 degrees, until a second maximum temperature $T\mathbf{2}_{max}$ is reached. The values of $T\mathbf{1}_{max}$ and $T\mathbf{2}_{max}$ being comprised between the values of variable temperatures indicated above. Preferably, when $T\mathbf{2}_{max}$ is reached, the velvet is kept in the liquid to be dyed for a dyeing time of between 30 and 120 minutes, preferably between 40 and 100 minutes, more preferably between 50 and 80 minutes, even more preferably about 60 minutes. $T\mathbf{2}_{max}$ is maintained constant throughout the dyeing time.

In a preferred embodiment, once the dyeing time has elapsed, the temperature $T\mathbf{2}_{max}$ is gradually decreased until it reaches $T\mathbf{1}_{max}$. The gradual decrease in temperature is achieved by decreasing the temperature of the dyeing liquid by at least 1° C., preferably about 1 degree.

The variation in temperature, in particular the gradual increase in temperature, which the velvet fabric undergoes during the dyeing step at least partially soften the warp yarns and/or the weft yarns of the support. Subsequently, the also gradual cooling of the temperature causes the warp yarns and/or weft yarns to harden, thereby producing a rigid support which imparts rigidity to the velvet fabric of the invention. The gradual increase and decrease in temperature allows better action of the dyes and/or other dye auxiliaries and a progressive migration of the dyes to the interior of the polyester. The polyester at low melting temperature gradually softens with the rise in temperature and dyes at high temperature as normal polyester, i.e. above 100° C. The process thus makes it possible to manufacture a velvet fabric which at the same time produces a rigid and dyed support. The process considerably reduces the time and/or costs of production.

The melting of the warp and/or weft yarns of the support can also take place before the dyeing step, for example by drying in an oven. Said melting is carried out at a temperature of about 200° C., preferably about 210° C., more preferably about 225° C., even more preferably about 250° C. Melting takes place for about 5 minutes, preferably about 7 minutes, more preferably about 9 minutes, even more preferably for about 11 minutes.

In a preferred embodiment, the volume of dyeing liquid used to dye 125 kg of velvet fabric is between 1500 and 5000 liters, preferably between 2000 and 4000 liters, more preferably between 2500 and 3000 liters. The dyeing liquid comprises water to which dyeing products are added known to those skilled in the art.

The dyeing step can be repeated several times, using the same dyeing liquid or different dyeing liquids, until the desired color is obtained.

After having removed the velvet fabric from the dyeing liquid, the fabric undergoes a reduction treatment with hydrosulfite as well as rinsing with lukewarm water followed by rinsing with cold water. Preferably, sodium hydrosulfite or sodium dithionite $Na_2S_2O_4$ is used to remove excess dye and therefore to ensure a good friction resistance of the color of the finished fabric. Acid neutralization can also be achieved by rinsing with cold water.

In a preferred embodiment, the process comprises at least one step of drying the velvet fabric in which the drying temperature is between 120 and 180° C., preferably between 130 and 170° C., more preferably between 140 and 160° C. Drying is carried out following the rinsing of the velvet fabric.

In another aspect, the invention provides the use of the velvet fabric in a method of transforming said fabric, provides a method of transforming the velvet fabric, and also provides the products obtained by said process. Said transformation method is heat-capable, thus including a step of heating the velvet fabric at a temperature which varies between 80 and 250° C., preferably between 90 and 200° C., more preferably between 100 and 180° C., even more preferably between 110 and 150° C. or any value between those indicated. The method also comprises the step of transforming the heated velvet fabric. Said transformation process is selected from molding, thermoforming, embossing of the velvet fabric or any combination of said processes. The products obtained are chosen from the group comprising and not limited to: packaging, luminaires, wall tiles, etc.

The method of molding or thermoforming comprises the following steps: (i) heating the velvet fabric to a temperature as described below, (ii) placing the heated velvet fabric in a mold, (iii) letting the fabric cool in the mold and (iv) removing the fabric from the mold after cooling, thereby obtaining the desired product. The heated fabric may be placed in the mold so that the rigid side of the fabric is in contact with the inner wall of the mold or so that the rigid side of the fabric is not in contact with the inner wall of the mold. The cooling step may be carried out at room temperature or may be accelerated by any means known to those skilled in the art such as the application of cold air to the mold.

The embossing process comprises the following steps: (i) heating the velvet fabric to a temperature as described below, (ii) creating reliefs on the fabric and (iii) letting the fabric cool, thereby obtaining the desired product. The cooling step may be carried out at room temperature or may be accelerated by any means known to those skilled in the art such as the application of cold air to the mold.

The velvet fabric of the present invention is capable of maintaining any shape attributed to it by one of the transformation processes mentioned above. This is not the case with the velvet fabrics of the prior art which, in order to maintain a certain shape, require a treatment prior to the transformation process, such as, for example, bonding with a foam or a non-woven fabric. The velvet fabric of the invention as well as its use in a transformation process thus makes it possible to obtain desired products while simplifying the manufacturing process, reducing working time as well as reducing the use of chemical products such as glue.

The velvet fabric of the present invention may also be treated prior to any of the above-described transformation processes. The treatment comprises bonding the velvet fabric to another material, such as a non-woven or a foam, or any other treatment known to those skilled in the art.

The embodiment described in the foregoing and illustrated in the accompanying FIGURES is an example given by way of illustration and the invention is in no way limited to this example. Any modification, variant or equivalent arrangement shall be deemed as being comprised within the scope of the invention.

What is claimed is:

1. Method of manufacturing a velvet fabric wherein a support formed by warp yarns and weft yarns is used, such that the weft yarns are inserted and interwoven with warp yarns, comprising:

inserting at least one filling yarn into the support, wherein said filling yarn is anchored in the form of loops or bristles in the support, and wherein the filling yarn emerges from at least one surface of the support, thereby obtaining the velvet fabric, and wherein the warp yarns and/or the weft yarns of the support are at least partially formed of polyester at a low melting temperature and wherein the melting temperature of the warp yarns and/or weft yarns of the support is less than 250° C., melting the warp and/or weft yarns of the support at a temperature of at least 200° C., dyeing the velvet fabric, wherein said dyeing is initiated at an initial temperature Ti of a dying liquid, the temperature of the dying liquid is increased at least to 130° C., and is subsequently decreased, and conducting a reduction treatment on the velvet fabric, followed by rinsing with lukewarm water and with cold water.

2. Method according to claim 1, wherein the melting temperature of the warp yarns and/or the weft yarns of the support is less than 200° C.

3. Method according to claim 1, wherein the composition of the warp yarns and/or weft yarns comprises at least 50% of polyester.

4. Method according to claim 1, wherein the temperature of the dying liquid is gradually increased from the initial temperature Ti.

5. Method according to claim 1, wherein Ti is at least 20° C.

6. Method according to claim 1, wherein the temperature of the dying liquid is increased from 20° C. to 250° C.

7. Method according to claim 1, wherein the duration of the dyeing step is 120 min or less and the maximum temperature is maintained throughout 50 to 80 minutes.

8. Method according to claim 1, further comprising the step of drying the velvet fabric wherein the drying temperature is between 120 and 180° C.

9. Method according to claim 1, wherein the melting temperature of the warp yarns and/or the weft yarns of the support is less than 170° C.

10. Method according to claim 1, wherein the composition of the warp yarns and/or weft yarns comprises at least 60% of polyester.

11. Method according to claim 1, wherein Ti is at least 30° C.

12. Method according to claim 1, wherein the melting takes place for at least 5 minutes.

* * * * *